US005412393A

United States Patent [19]

Wiggenhorn

[11] Patent Number: 5,412,393

[45] Date of Patent: May 2, 1995

[54] RETRACTABLE ANTENNA ASSEMBLY WITH BOTTOM CONNECTOR

[75] Inventor: James T. Wiggenhorn, Coral Springs, Fla.

[73] Assignee: Motorola, Inc., Schaumburg, Ill.

[21] Appl. No.: 207,239

[22] Filed: Mar. 7, 1994

Related U.S. Application Data

[63] Continuation of Ser. No. 8,429, Jan. 25, 1993, abandoned.

[51] Int. Cl.[6] ..... H01Q 1/24; H01Q 1/10

[52] U.S. Cl. ..... 343/702; 343/901

[58] Field of Search ..... 343/702, 906, 900, 901, 343/715; 439/916; H01Q 1/24, 1/10

[56] References Cited

U.S. PATENT DOCUMENTS

| | | | |
|---|---|---|---|
| 2,677,973 | 5/1954 | Gosline | 343/906 |
| 4,525,718 | 6/1985 | Imazeki et al. | 343/702 |
| 5,072,230 | 12/1991 | Taniyoshi et al. | 343/715 |
| 5,204,687 | 4/1993 | Elliott et al. | 343/895 |

FOREIGN PATENT DOCUMENTS

| | | | |
|---|---|---|---|
| 0508836 | 10/1992 | European Pat. Off. | H01Q 1/24 |
| 0516490 | 12/1992 | European Pat. Off. | H01Q 1/24 |
| 2257837 | 1/1993 | United Kingdom | H01Q 1/10 |

*Primary Examiner*—Donald Hajec
*Assistant Examiner*—Hoanganh Le
*Attorney, Agent, or Firm*—Andrew S. Fuller

[57] ABSTRACT

A retractable antenna assembly with a bottom connector (200) allows communication devices that require the use of more than one type of antenna element (114), to easily store the normally used antenna element (114) inside of a transmission line housing (144) which is part of the antenna assembly (200). Once inside of the housing (144), the antenna element (114) is hidden within the transmission line housing that has a 50 ohm impedance at the operating frequency of the communication device (302), thereby operatively decoupling the antenna element (114) from the radio frequency path. Once inside of the housing (144), the antenna element (114) is connected to part of a coaxial connector (112) with the bottom portion (120) of the antenna element (114) connected to the center conductor of the coaxial connector (112), thereby allowing for an external antenna element (308) to be attached to the communication device (302).

13 Claims, 4 Drawing Sheets

RETRACTABLE ANTENNA ASSEMBLY WITH BOTTOM CONNECTOR

CROSS REFERENCE TO RELATED APPLICATIONS

This is a continuation of application Ser. No. 08/008,429, filed Jan. 25, 1993, and now abandoned.

This application is related to copending U.S. application Ser. No. 07/987,590, filed Dec. 8, 1992, entitled "Retractable Antenna Assembly with Connector", by James T. Wiggenhorn, and assigned to Motorola, Inc.

TECHNICAL FIELD

This invention relates to antennas, and more specifically to a retractable or collapsible antenna assembly.

BACKGROUND

In many radio communication applications, it becomes necessary to disconnect the communication device's antenna and connect a different antenna, usually an antenna having better gain characteristics. This is typically the case with transportable radios, where the standard or internal antenna that is used by the radio is usually removed, or somehow disconnected from the radio frequency path, in order to connect a mobile mount or external antenna upon the radio user entering a vehicle. The problem with disconnecting the internal antenna from the radio and reconnecting the external antenna is that the radio user then has to worry about not losing the internal antenna that has been removed. Another problem occurs in certain types of radios where the internal antenna has to be removed in order to run operational tests, such as power output tests, which cause the radio user to have to remove the internal antenna in order to perform the tests. A need, therefore, exits for an antenna assembly which can overcome the above mentioned problems associated with present day radio antenna assemblies.

SUMMARY OF THE INVENTION

Briefly described, the present invention contemplates a retractable antenna assembly which allows for the attachment of an external antenna when the antenna element is in the retracted position.

In one aspect of the invention, an antenna assembly comprises an internal antenna feedpoint and a transmission line housing including a dielectric sleeve. The antenna assembly further includes an antenna element coupled to the antenna feedpoint and to the feedpoint end of the transmission line housing, and carried by the housing, the antenna element being movable between a first position wherein the antenna element forms an active antenna portion and a second position substantially within the dielectric sleeve wherein the antenna element and the housing forms a continuous transmission line for connecting to an external antenna.

In another aspect of the present invention a communication device utilizing an antenna assembly is described.

DETAILED DESCRIPTION OF THE PREFERRED EMBODIMENT

Figure 1:
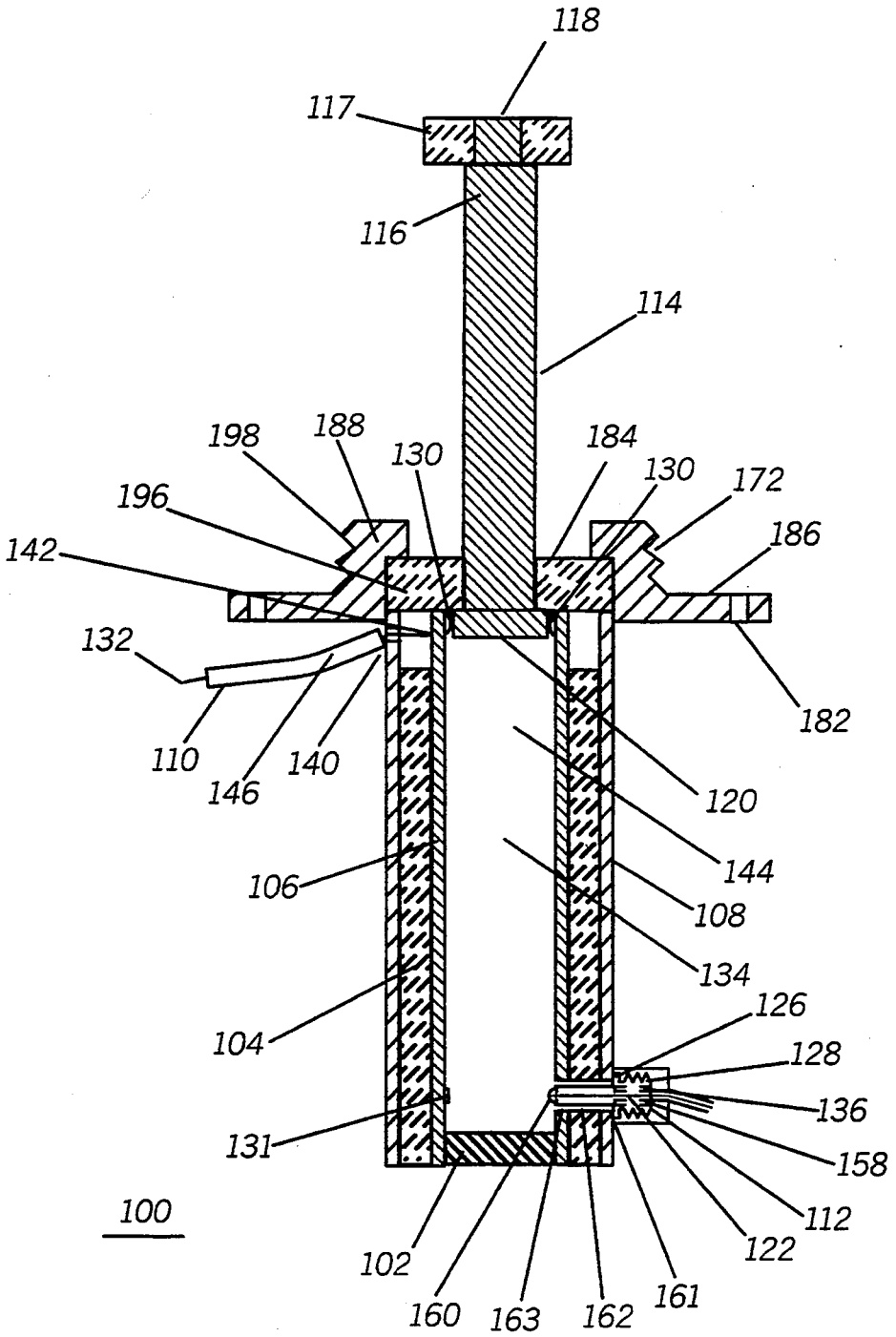
In FIG. 1 an antenna assembly in accordance with the present invention is shown.

Referring to FIG. 1, there is shown an antenna assembly 100 in accordance with the present invention. Antenna assembly 100 comprises a connector means 112 which can take a form similar to a conventional 50 ohm BNC (sometimes, referenced as UG-290) connector. Connector means 112 includes a support section 126 having apertures 122 which are used to fasten the antenna assembly 100 to a radio housing (not shown). Connector means 112 also includes an insulator 136 such as a conventional low loss insulator as known in the art, in order to insulate a center conductor 158 from "shorting" to the outside portion (or first connector contact) 128 of connector means 112, which in the preferred embodiment is at ground potential.

The center conductor or signal contact 158 of the connector means 112 is connected to an external contact 160 which may be in the form of a compressible metal finger or plunger for selective connection with the bottom antenna portion 120. A pair of protrusions 138 is also part of the connector means 112 and facilitates the connection or quick disconnect of an external antenna or RF cable to the 50 ohm connector for selectively biasing the plunger 160.

Attached to connector means 112 is a transmission line housing 144 which includes the cylindrical outside sleeve 108 which is connected to connector contact 128 and is at ground potential. A cylindrical center conductor sleeve 106 is also part of the housing 144 and it helps form an inner or storage cavity 134 for an internal antenna element 114 to reside in, when the internal antenna element 114 is in the retracted (second) position. Center conductor sleeve 106 is coupled to antenna 114 when antenna 114 is in either the "up" position or "down" retracted position since contact means 130 is coupled to the center conductor sleeve 106. Between the center conductor sleeve 106 and the outside sleeve 108 is found a cylindrical dielectric sleeve 104, which in the preferred embodiment has a dielectric constant of 4. The dielectric sleeve 104 may be formed from a material such as nylon, or acetate, or other suitable materials known in the art. If a different dielectric constant is required (e.g. designing for a different operational frequency or a different characteristic impedance) a different material having the dielectric properties needed can be used.

The bottom portion of housing 144 includes a biasing means 102 which helps bias antenna element 114 upwardly when antenna element 114 is placed in the retracted (second) position. This helps the radio user pull the antenna element 114 out from cavity 134 when the user wants to place the antenna element in the active or first position, since the bias means 102 pushes top portion 116 above the antenna contact means 130. Bias means 102 can be any resilient member such as rubber or a spring member which can provide upward bias to antenna element 114. Bias means 102 should be made from a nonconductive material such as resilient rubber, a plastic spring, foam, etc. Preferably, bias means 102 can be friction fit within the diameter of center conductor sleeve 106, or held by other well known mechanical means.

The internal antenna element 114 includes a top portion 116, having a cavity portion 118, and a bottom portion 120. The bottom portion 120 engages antenna contact means 130 which help maintain antenna 114 in the first, extended, or active position, when antenna 114 is pulled up from the storage or inner cavity 134 of the housing 144. Antenna element 114 reaches its maximum height when antenna bottom portion 120 presses against the side portion of the antenna contact means 130. Antenna element 114 is preferably manufactured from an electrical conductive material such as aluminum or other similar metal.

Contact means 130 couples with the bottom antenna portion 120 at antenna feedpoint 142, thereby providing an electrical connection with the center conductor 132 of radio frequency (RF) cable 110 (which is usually coupled to a communication receiver and/or transmitter). Antenna feedpoint 142 is the location in the center conductor sleeve 106 where the center conductor 132 is attached (e.g. soldered, mechanically fastened, etc.). An opening in an outer sleeve 108 of the transmission line allows the center conductor 132 of the RF cable 132 to go through the sleeve 108 without making electrical contact, thereby preventing the center conductor 132 from "shorting" to the outer sleeve 108 which is at ground potential. The outer conductor (ground shield) 146 of cable 110 is connected to the outer sleeve 108 at ground connection point 140 thereby putting outer sleeve 108 at ground potential. Contact means 130 is designed as a set of compressible metal fingers as known in the art, which forces a friction fit with the bottom portion 120 of antenna 114, when antenna 114 is in the first or active position ("up" position). Contact means 130 is electrically coupled to antenna feedpoint 142, and center conductor sleeve 106. The contact means 130 constantly makes contact with antenna element 114 (either in the active or retracted position), by expanding or contracting the metal fingers. Contact means 130 can also be designed by forming a threaded portion (not shown) on the top portion of center conductor sleeve 106 which the bottom portion 120 of antenna element 114 can thread into, for example by turning antenna element 114 a quarter turn when it reaches its maximum operational height. The threading method would also require having a way of making contact to antenna element 114 at all times in order to electrically couple antenna feedpoint 142 to antenna element 114.

Figure 2:
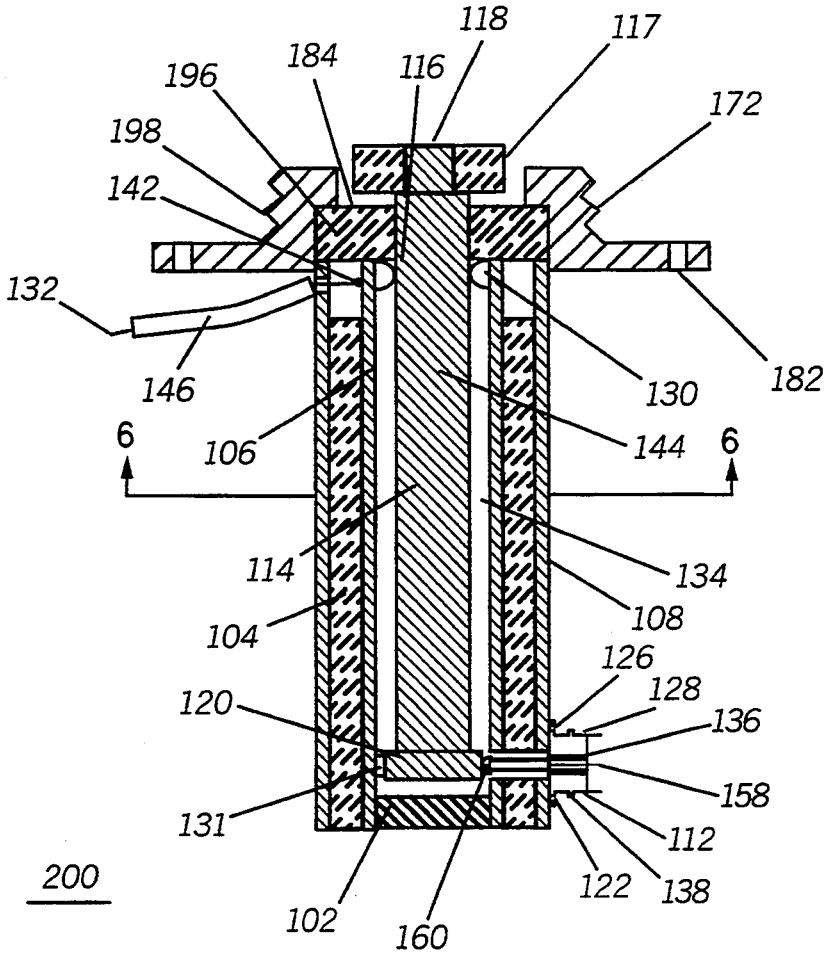
In FIG. 2 the same antenna assembly as shown in FIG. 1 is shown in the retracted position, in accordance with the present invention.

In FIG. 2, the same antenna assembly as shown in FIG. 1 is shown, this time in the retracted or down (second) position in accordance with the present invention.

Figure 6:
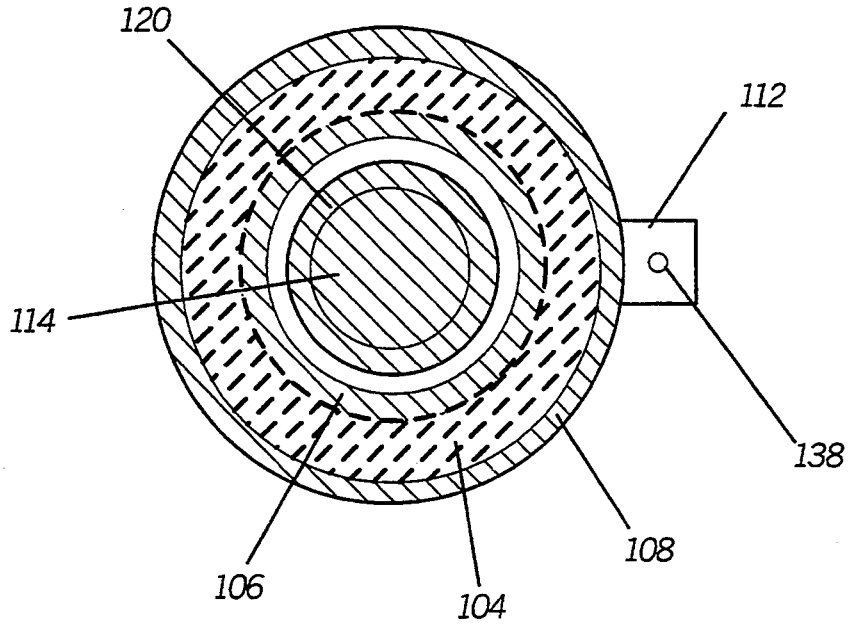
In FIG. 6 a cross-sectional view taken along line 6—6 in the assembly of FIG. 2.

In either the extended or retracted position, the electrical presence or absence of the antenna 114 does not affect the characteristics of the transmission line, preferably having a matched impedance of 50 ohms at the operating frequency of antenna 114 for minimizing transmission loss. The cavity formed by the coaxial transmission line assembly of the outside grounded sleeve 108, center conductor sleeve 106, and dielectric sleeve 104 hides the effects of the antenna element 114 to exhibit a desired 50 ohm impedance based on the diameter ratios of the grounded sleeve 108 and center conductor sleeve 106, at a given dielectric constant, as seen in equation 1 and FIG. 6. This transmission line, in effect, renders antenna element 114 "transparent", or operatively decoupled from antenna feedpoint 142, when antenna element 114 is in the second or retracted position by "hiding" it within the center conductor sleeve 106 of the 50 ohm transmission line.

The 50 ohm transmission line allows an external antenna (not shown) to be attached and properly matched to connector means 112. Apertures or receptacle areas 171–173, in the outside sleeve 108, the dielectric sleeve 104, and the center conductor sleeve 106, respectively, receive the external contact 160. The external contact 160 acts as the center conductor contact (or second connector contact) for the coaxial connector formed by connector means 112, while the ground contact is provided by first connector contact 128 which is at ground potential. Any antenna which is connected to connector means 112 will automatically be electrically connected by the center conductor sleeve 106 and/or the antenna bottom portion 120 to antenna feedpoint 142 which will then be coupled (via RF center conductor wire 132) to the appropriate receiver and transmitter sections by RF cable 110 which will be found inside of the radio itself. The external contact 160 which may be formed from a compressible metal finger expands outwardly when antenna element 114 is in the retracted (second) position in order for the external contact 160 to make contact with the antenna element 114, thereby forming the electrical connection between the input (feedpoint 142) and output (50 ohm termination or external antenna), or vice a versa, of the transmission line. It is noted that the external contact 160 is sufficiently small, relative to the center conductor aperture 163 such that it does not engage the center conductor sleeve 106 but engages the bottom portion 120 of the antenna element 114 only when the antenna 114 is in the retracted (second) position. In the retracted position, the bottom portion 120 is preferably large enough or surrounded by an optional conductive disk 131, fixed on the center conductive sleeve 106, such that the bottom portion 120 also engages the opposing side wall of the conductive sleeve 106 when the plunger 160 makes contact with the bottom portion 120 to provide the continuous 50 ohm transmission line characteristic. As seen in FIG. 2, the center conductor aperture 163 is sufficiently large, for exposing the bottom antenna portion 120 which is perpendicular to the connector means 112, and for breaking the 50 ohm coaxial transmission line and 90 degree bend continuation with the 50 ohm connector means 112.

Figure 4:
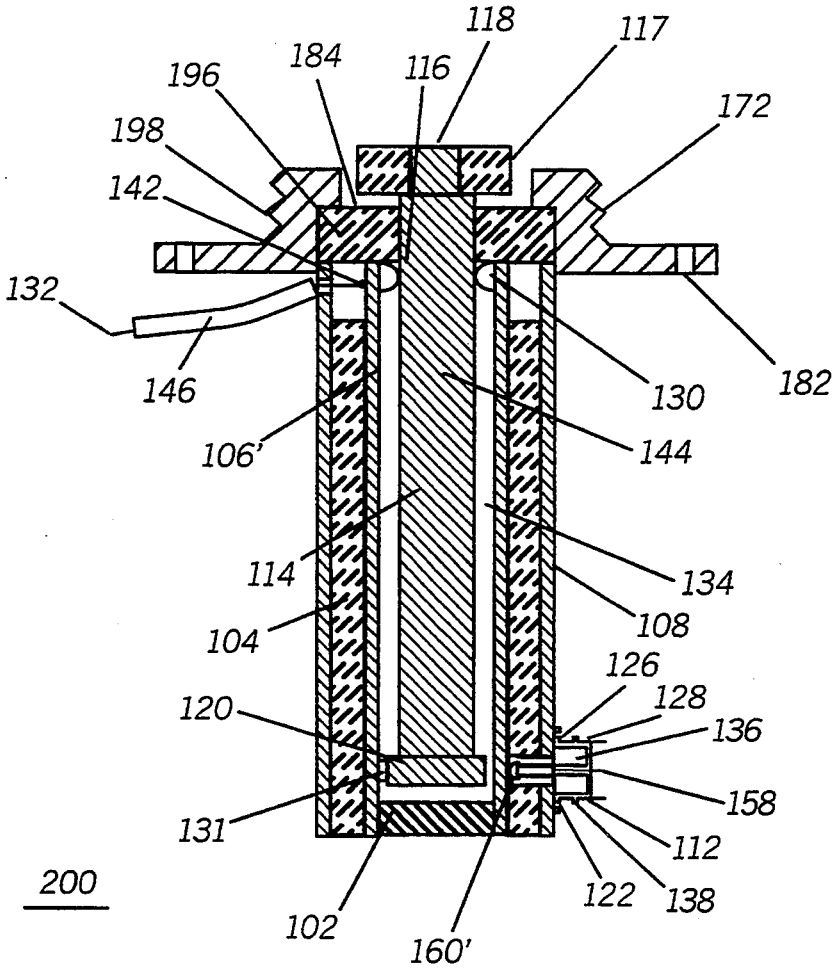
In FIG. 4 an antenna assembly in accordance with an alternate embodiment of the present invention is shown.
Figure 5:
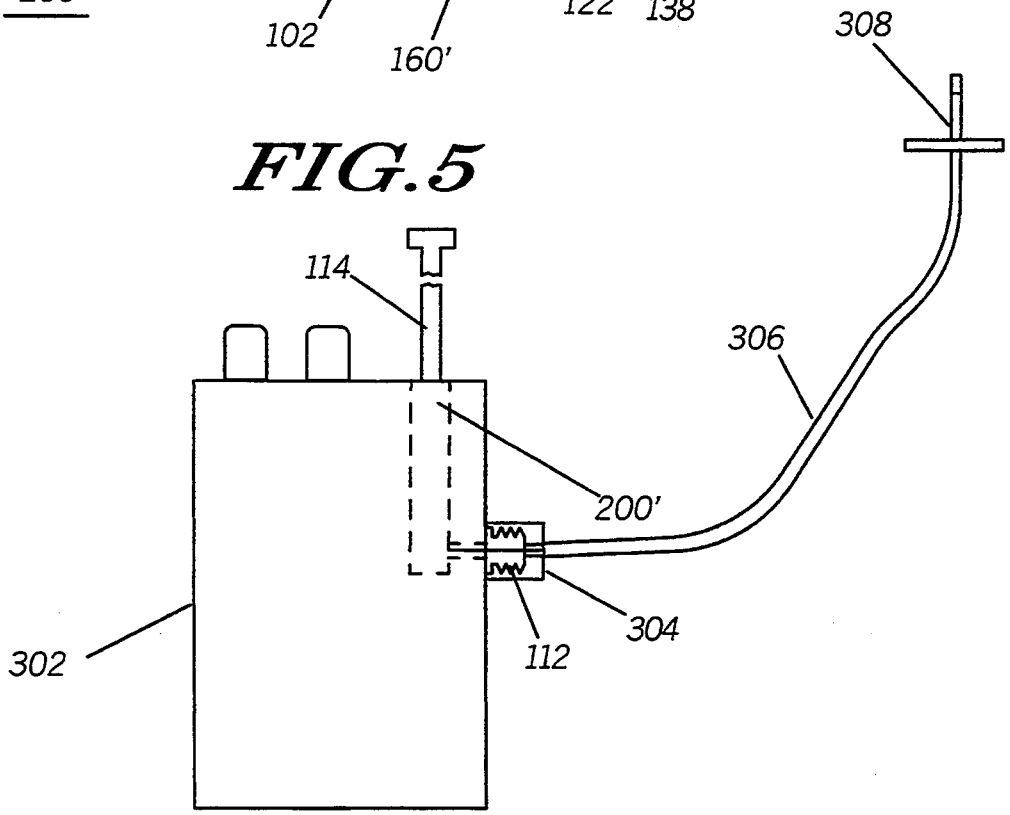
In FIG. 5 the same antenna assembly as shown in FIG. 4 is shown in the retracted position, in accordance with the present invention.

Alternately, as seen in FIGS. 4–5, where the prime notations denote a slight variation from the unprimed representations and corresponding parts are identified with same reference numbers. In this embodiment, the center conductor sleeve 106' need not have a bottom side aperture at all for exposing the bottom antenna portion 120. Instead, an external contact or plunger 160' may always engage the outside wall of the center conductor sleeve 106'. In this case, however, since the 50 ohm transmission line is always connected with the 50 ohm connector means 112, via the 90 degree bend made possible by the plunger 160', the external antenna 308 needs to be disconnected (phantom line representation) if the internal antenna 114 is extended.

The typical dimensions for the housing 144 are easily calculated using an antenna design manual, or similar technical publication well known in the art. For the design of an antenna assembly 100 having an operational frequency of 450 Mhz, the calculations for the cavity diameters (diameters of outer sleeve 108 and center conductor sleeve 106) are as follows:

$$Z_0 = \frac{138}{\sqrt{E_r}} \log_{10} \frac{D}{d} \quad \text{(Equation 1)}$$

$$50 = \frac{138}{2} \log_{10} \frac{D}{d}$$

$$\frac{100}{138} = \log_{10} \frac{D}{d}$$

if $D = .375$ inch $= .9525$ cm then $$.7246 = \log_{10} \frac{.375}{d}$$

$$d = .0707 \text{ inch} = .1796 \text{ cm}$$

where "$Z_o$" is the impedance designed for, in this case 50 ohms, "D" is the diameter of the outside sleeve 108, "d" is the diameter of the center conductor sleeve 106, and "Er" is the dielectric constant of the dielectric cylindrical sleeve 104. The diameter of the dielectric sleeve 104 can be any size that will allow for it to fit within outside sleeve 108 and center conductor sleeve 106 while taking into account the thickness of the dielectric sleeve 104. By making the dielectric out of nylon, or acetate material having a dielectric constant of 4.0, and designing for a D of 0.375 inch, we calculate a "d" equalling 0.0707 inch. Although nylon is the preferred material for the dielectric, other similar materials may be utilized. Both the outside sleeve 108 and center conductor sleeve 106 can be formed from an electrically conductive material such as aluminum, or another metal which is easily extruded into a cylindrical shape. The metal concentric sleeves 106 and 108 are electrically insulated from each other by the dielectric sleeve 104.

The length of antenna 114 for an operating frequency of 450 Mhz can be easily calculated by the following formula:

$$L_x = \frac{300 \times 10^6}{450 \times 10^6} \text{ meters} = .667 \text{ meters.} \quad \text{(Equation 2)}$$

If designing for a quarter wavelength ($\lambda/4$) antenna element 114:

$$L_{x/4} = 0.667/4 = 16.67 \text{ centimeters} = 6.56 \text{ inch.}$$

Due to end "effects," the practical physical length of antenna element may be closer to 6.25 inch (or 15.88 cm) at 450 Mhz. Depending on the operational frequency and or transmission line characteristic impedance being designed for, the length, diameters, and dielectric constant, will require appropriate recalculations of the above formulas in order to achieve maximum operational results. Antenna element 114 could be designed as a quarter wavelength, as in the preferred embodiment, $\frac{5}{8}$ wavelength or any other practical size. Also, antenna element 114 can be designed as a single piece element or as a telescoping antenna element.

If the dielectric material is chosen, in combination with the physical length of the antenna that is retracted in the cavity 134, to provide an effective electrical length of the combination at a half wavelength, the combination forms a halfwave resonance ("cavity") that has a high impedance, looking below the feedpoint 142, at the operating frequency of antenna 114. In other words, by choosing the appropriate dielectric material having the desired dielectric constant, the cavity formed by outside sleeve 108, center conductor sleeve 106, and dielectric sleeve 104 causes antenna element 114 to exhibit a halfwave resonance (having approximately twice the electrical length of antenna 114). This $\lambda/2$ cavity, in effect, additionally, renders antenna element 114 operatively decoupled from antenna feedpoint 142 when antenna element 114 is in the second or retracted position because the high impedance presented at the approximately top end of the $\lambda/2$ cavity, close to the feedpoint 142, shunts any currents from flowing into the cavity of the housing 144.

For the design of an antenna assembly 100 having an operational frequency of 450 Mhz, the calculations for the length of the half wave cavity (outside sleeve 108) are as follows:

$$L_{\lambda/2} = \frac{1}{2\sqrt{E_r}} \times \frac{300 \times 10^6}{f(\text{mhz})} \quad \text{(Equation 3)}$$

$$30 = \frac{1}{2\sqrt{4}} \times \frac{300 \times 10^6}{450 \times 10^6}$$

$$= \frac{1}{4}(.667)$$

$$= 16.67 \text{ cm} = 6.56 \text{ inch}$$

where "Er" is the dielectric constant, in this case 4.

The dielectric constant of 4 is specially chosen to provide a physical length that is approximately equal to a quarter wavelength. An additional benefit of the outside sleeve 108 being approximately a quarter wavelength is that a quarter wave ground plane or counterpoise is now formed when the antenna element 114 is in the first or active position, making the quarter wavelength antenna element 114 resemble a dipole antenna, thereby providing better gain characteristics.

Optionally, a top connector 172 which can take a form similar to the conventional UHF antenna connector, such as the industry standard UL-259 connector may be placed on top of the transmission or at the feedpoint end of the transmission line housing 144. Similar to the bottom side connector means 112, the top connector 172 includes a support section 186 having apertures 182 which are used to fasten the antenna assembly 100 to the radio housing (not shown). The top connector 172 also includes an insulator 196, in order to insulate the center conductor, which is formed by the antenna element 114 from "shorting" to the outside portion (or first connector contact) 188 of the top connector 172, which in the preferred embodiment is at ground potential. The top cavity 118 forms a coupling means which is basically a receptacle area on the top portion 116 of the internal antenna element 114 and acts as the center conductor contact (or second connector contact) for the coaxial connector formed by the top connector 172, while the ground contact is provided by the first connector contact 188. An optional dielectric top portion 117 surrounds the top cavity 118 to provide a safe "handle" for the user to pull out the antenna 114.

The internal antenna element 114 reaches its maximum height when the antenna bottom portion 120 presses against the bottom portion of the insulator 196. A threaded portion 198 is also part of the top connector 172 and provides for the connection to an external antenna, RF cable, or a different internal antenna, if the bottom side connector means 112 is not terminated.

Obviously, if the top connector 172 is not required, its component parts should be eliminated such that the tip of the antenna top portion 116 can be as close to the feedpoint end of the transmission line 144, as possible, when the antenna 114 is in the retracted postion, to eliminate or reduce potential stray or other electromagnectic effects from having too large of a top portion of the antenna, extending too far above the feedpoint.

Figure 3:
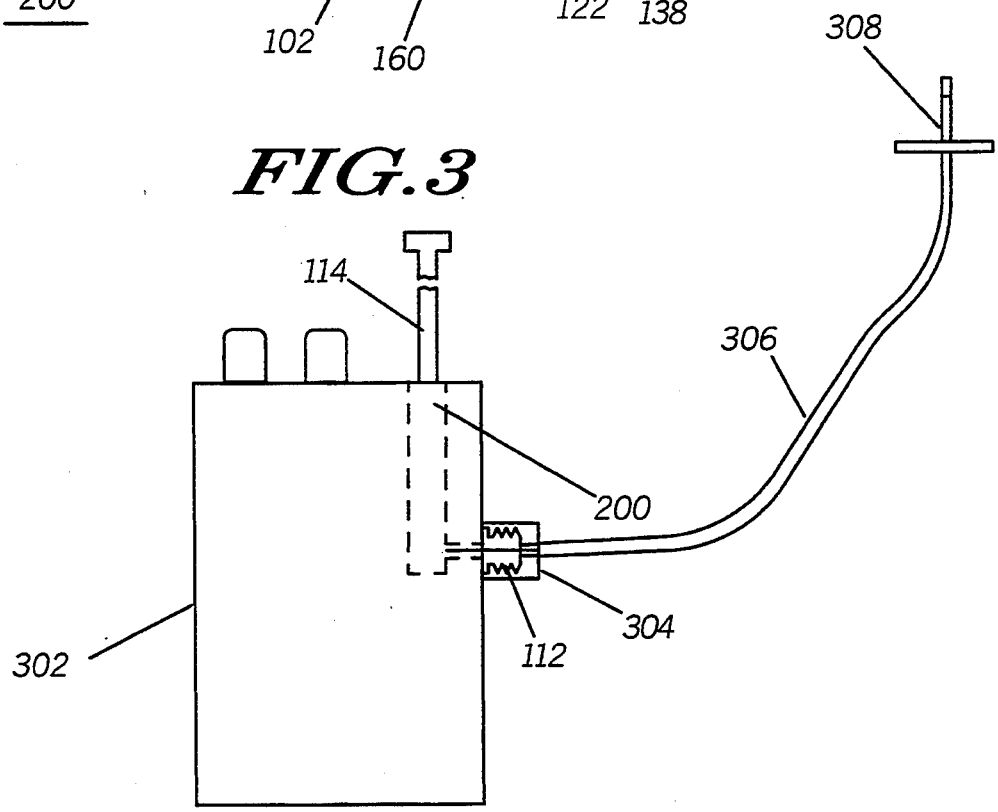
In FIG. 3 a radio utilizing an antenna assembly in accordance with the present invention is shown.

In FIG. 3, a radio 302 utilizing the antenna assembly 200 of the present invention is shown. Radio 302 includes a conventional receiver and transmitter (not shown) which are selectively coupled to antenna assembly 200 via an antenna switch which is in turn coupled to RF cable 110 of FIG. 1. A mobile mount antenna 308 (external antenna) is shown connected to the connector means 112 of antenna assembly 200. In this particular example, a conventional 50 ohm BNC (UG-290A) connector 304 is used to connect mobile antenna 308 to radio 302. A conventional coaxial antenna cable such as a 50 ohm coax 306 is utilized to connect between radio 302 and the external mobile antenna 308 which is typically mounted on the outside of a vehicle. However, because the plunger or external contact 160 connector means 112 provides a proper 50 ohm termination to the transmission line housing 144, the connector means 112 can be left unterminated or terminated by the external antenna 308.

Although the preferred embodiment has shown a housing 144 formed using a center conductor sleeve 106, one could just as well not use the center conductor sleeve 106 and rely on the antenna element 114 to form the half wave transmission line (cavity) when it is retracted into the recess area 134. The benefit of having the center conductor sleeve 106, connected to the center conductor 132 of the RF path is that one can then use a telescoping antenna, in the first or active (up) position, which closes down or collapses to a different size when it is inside of the cavity area 134.

In summary, the present invention provides for a simple way of "disconnecting" an antenna element 114 from a radio 302, by simply retracting the antenna element into a housing 144 which is part of the antenna assembly 200. Once in the retracted mode, the connector means 112 allows the radio user to attach a new antenna element 308 without having to remove the original antenna element 114 because the transmission line preserves the same impedance within the transmission line, as the impedance of the antenna feedpoint and of the bottom side connector.

What is claimed is:

1. An antenna assembly, comprising:

a transmission line comprising a housing having first and second ends, the housing including a dielectric sleeve and a conductive sleeve, the housing having a cavity extending from the first end toward the second end;

an antenna feedpoint electrically coupled to the transmission line;

an antenna element carried by the housing, the antenna element being movable within the transmission line between a first position wherein the antenna element forms an active antenna portion, and a second position substantially within the transmission line wherein the antenna element is operatively inactive as an antenna; and connector means, for supporting an external antenna connection when the antenna element is in the first position and when the antenna element is in the second position, the connector means having a contact portion located toward the second end of the housing, the connector means being electrically coupled by the antenna element to the antenna feedpoint when the antenna element is at the second position, the connector means being electrically decoupled from the antenna feedpoint when the antenna element is at the first position.

2. The antenna assembly of claim 1, wherein:

the transmission line has an effective electrical length of a half wavelength.

3. The antenna assembly of claim 1, wherein:

the antenna feedpoint is electrically coupled near the first end of the housing.

4. The antenna assembly of claim 1, wherein:

the antenna element has an antenna contact portion which engages the contact portion when the antenna element is in the second position.

5. The antenna assembly of claim 1, wherein the antenna element is approximately a quarter wave length when in the first position.

6. The antenna assembly of claim 1, wherein the antenna element is a telescoping antenna element.

7. The antenna assembly of claim 1, wherein the transmission line housing includes an outside sleeve which is at ground potential and a center conductor sleeve coupled to the antenna feedpoint, the dielectric sleeve being located between the outside sleeve and the center conductor sleeve.

8. The antenna assembly of claim 7, wherein the center conductive sleeve has a conductive disk near the second end of the housing for engaging the antenna element when the antenna element is at the second position.

9. The antenna assembly of claim 8, wherein the contact portion of the connector means is electrically coupled to the conductive sleeve and the conductive sleeve electrically coupled to the antenna feedpoint, when the antenna element is at the second position.

10. The antenna assembly of claim 9 wherein the coaxial connector is positioned perpendicular to the antenna element.

11. The antenna assembly of claim 1, wherein the connector means includes a coaxial connector having a signal contact and a ground contact.

12. A communication device, comprising:

a transceiver; and an antenna assembly coupled to the transceiver, the antenna assembly including:

a transmission line comprising a housing having first and second ends, the housing including a dielectric sleeve and a conductive sleeve, the housing having a cavity extending from the first end toward the second end;

an antenna feedpoint electrically coupled to the transmission line;

an antenna element carried by the housing, the antenna element being movable within the transmission line between a first position wherein the antenna element forms an active antenna portion and a second position substantially within the within the transmission line wherein the antenna element is operatively inactive as an antenna;

a connector attached to the housing and providing support for an external antenna connection when the antenna element is in the first position and when the antenna element is in the second position, the connector having a contact portion located toward the second end of the housing, the connector being electrically coupled through the contact portion to the antenna feedpoint when the antenna element is at the second position, the connector being electrically decoupled from the antenna feedpoint when the antenna element is at the first position.

13. An antenna assembly, comprising:

a transmission line having an effective electrical length of a half wavelength, the transmission line comprising a housing having first and second ends, the housing including a dielectric sleeve and a conductive sleeve, the housing having a cavity extending from the first end toward the second end;

an antenna feedpoint electrically coupled to the transmission line;

an antenna element carried by the housing, the antenna element being movable within the transmission line between a first position, wherein the antenna element forms an active antenna portion and has an effective electrical length of a quarter wave length, and a second position substantially within the transmission line wherein the antenna element is operatively inactive as an antenna; and a connector attached to the housing and providing support for an external antenna connection when the antenna element is in the first position and when the antenna element is in the second position, the connector having a contact portion located toward the second end of the housing, the connector being electrically coupled through the contact portion to the antenna feedpoint when the antenna element is at the second position, the connector being electrically decoupled from the antenna feedpoint when the antenna element is at the first position.

* * * * *